United States Patent [19]

Benno

[11] Patent Number: 4,730,437

[45] Date of Patent: Mar. 15, 1988

[54] PACKAGING METHOD AND MACHINE

[76] Inventor: Edward L. Benno, 17960 W. Hwy. 120, Grayslake, Ill. 60030

[21] Appl. No.: 49,112

[22] Filed: May 13, 1987

[51] Int. Cl.[4] ..... B65B 9/14; B65B 13/16; B65B 39/02; B65B 43/00

[52] U.S. Cl. ..... 53/399; 53/441; 53/459; 53/556; 53/567; 53/585

[58] Field of Search ..... 53/399, 459, 441, 556, 53/567, 585, 291, 293, 469, 450, 550; 493/255, 256, 309

[56] References Cited

U.S. PATENT DOCUMENTS

| | | | |
|---|---|---|---|
| 2,732,115 | 1/1956 | Allen | 53/441 X |
| 3,303,630 | 2/1967 | Harm | 53/450 X |
| 3,481,110 | 12/1969 | Titchenal | 53/567 |
| 3,621,638 | 11/1971 | Grocke | 53/567 X |
| 3,662,514 | 5/1972 | Goss | 53/567 X |
| 3,774,367 | 11/1973 | Lerner | 53/556 X |
| 3,792,564 | 2/1974 | Brady, Jr. | 53/585 X |
| 3,879,918 | 4/1975 | Lerner | 53/459 X |
| 3,916,769 | 11/1975 | Turunen | 53/567 X |
| 3,973,372 | 8/1976 | Omori | 53/450 X |
| 4,073,116 | 2/1978 | Glover | 53/550 |
| 4,144,631 | 3/1979 | Fujio | 53/291 X |
| 4,165,595 | 8/1979 | Pilley et al. | 53/556 |
| 4,208,857 | 6/1980 | Fujio | 53/585 |
| 4,286,421 | 9/1981 | Fujio | 53/399 |
| 4,288,968 | 9/1981 | Seko et al. | 53/550 |
| 4,412,876 | 11/1983 | Lerner et al. | 53/291 |
| 4,419,854 | 12/1983 | Okada et al. | 53/567 X |
| 4,454,705 | 6/1984 | Benno | 53/441 X |
| 4,514,966 | 5/1985 | Konstantin | 53/291 X |

*Primary Examiner*—Horace M. Culver
*Attorney, Agent, or Firm*—Edward L. Benno

[57] ABSTRACT

A packaging method and machine for placing highly stretched relatively thin elastic plastics tubes from a roll of such tubes about a series of generally rectilinear objects. The method and machine involve three basic mechanism, one is a jaw assembly that opens and closes and tilts up and down to receive and stretch a tube and release the tube about one of the objects, the second is a tube shuttle assembly that delivers a tube to the jaw assembly and retracts into the next tube, and the third is a chain and paddle conveyor that intermittently delivers objects to the jaw assembly and moves the objects from the jaw assembly after a tube has been applied.

20 Claims, 17 Drawing Figures

15
16
20
21
22
23
24
25
26
27
30
31
32
33
34
35
11

PACKAGING METHOD AND MACHINEBACKGROUND OF THE INVENTION

The subject invention is related to that area of the prior art where highly stretched, elastic, tensioned sleeves, bands or bags are applied about some object or objects to form a package. One of the important problems in that area is the problem of removing the sleeve-stretching members after application of the stretched sleeve to the object. The problem is compounded when the sleeve material is a relatively thin (1 to 2 mils) plastics material such as polyethylene because such materials commonly will easily tear or separate when greatly tensioned and scratched or cut. One solution to the problem is taught in my U.S. Pat. No. 4,454,705.

SUMMARY OF THE INVENTION

The method and the machine of the subject invention are based upon and use the teachings of my noted patent. With those teachings the subject invention comprises a unique, simple method and apparatus for delivering a plastic tube to the tube stretching elements. A reciprocating shuttle is positioned in the tube to hold the tube open and to apply the tube over the tube stretching jaws. The shuttle remains over the jaws while the jaws are moved to stretch the tube to a size large enough to receive the object to be encircled by the tube. With the tube highly stretched on the jaws it is virtually locked thereon and the shuttle is then axially removed from the tube. In retracting from the tube, the shuttle enters a new tube section for subsequent application to another object. In a preferred embodiment, the stretched tube is simply and easily separated from the remainder of the tube stock by initially forming the tube stock with perforations at appropriate positions along the stock, and by snapping the jaws generally transversely of the longitudinal axis of the tube. In a preferred embodiment that snapping is accomplished by initially tilting the jaws upwardly from the horizontal through an angle of about 30 degrees to receive the tube and shuttle, and after the tube has been stretched and the shuttle retracted, by lowering the jaws back to about the horizontal object receiving position. It should be noted that in practicing the invention the perforations should not be made so that separation occurs by the tube being fully stretched or when the shuttle starts to retract. The tube which is stretched on the jaws must hold the next tube section while the shuttle retracts. In the preferred embodiment of the shuttle and its associated elements shown in the drawings, reductions to practice have established that with that construction there is merely a slight pull or drag on the tube as the shuttle retracts. That slight drag on the tube as the shuttle retracts permits the perforations to be made to an extent greatly weakening the joint between tubes for easy transverse shearing.

The intermittently operating conveyor of the invention moves the object to be packaged between the jaws and within the stretched tube after the jaws have been lowered.

When the object is properly within the stretched tube, the jaws in fixed pairs are moved together to release the stretched tube to the object.

The conveyor is then operated to slide the object and applied tube off of the closed jaws. If the input end of the conveyor has received another object, that object will be moved by the conveyor as the packed object is slid from the jaws to signal the machine to then again tilt the closed jaws upwardly to receive another tube.

The primary object of the present invention is to provide a simple automatically operating machine for repeatedly and rapidly applying highly stretched thin-walled elastic plastics material tubing to generally rectilinear box or tray-like objects.

A feature of the preferred embodiments is that it is operated solely with compressed air from conventional available industrial shop air sources. No electrical nor vacuum power sources are needed at the machine.

Other objects and features of the invention will be apparent upon a perusal of the following detailed description read in conjunction with the drawings.

DETAILED DESCRIPTION OF THE DRAWINGS

Figure 10:
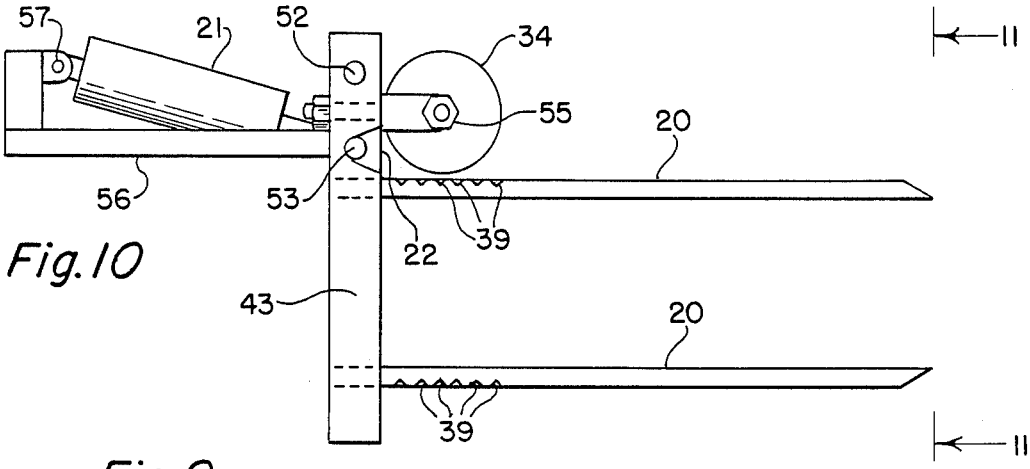
Figure 9:
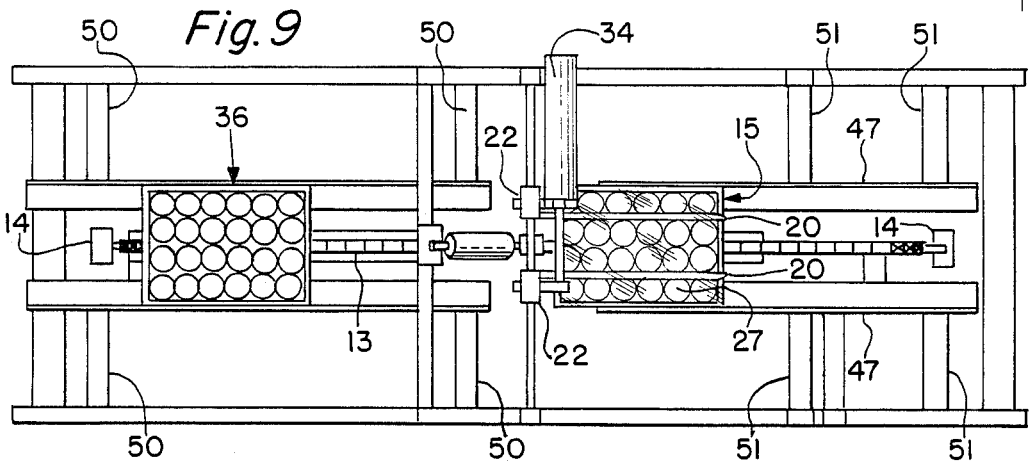
Figure 8:
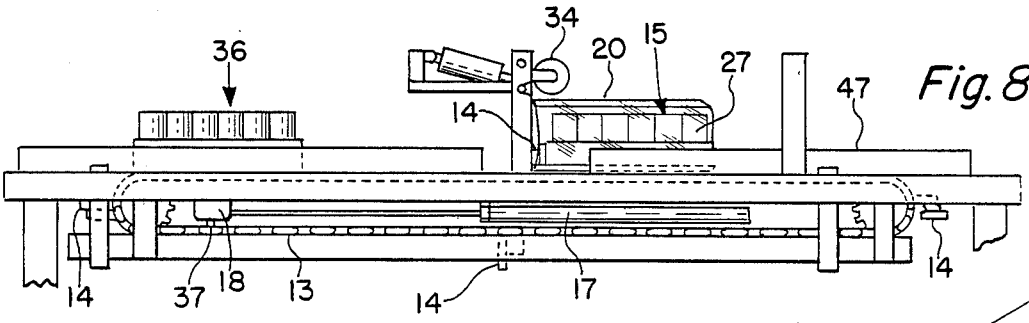
Figure 7:
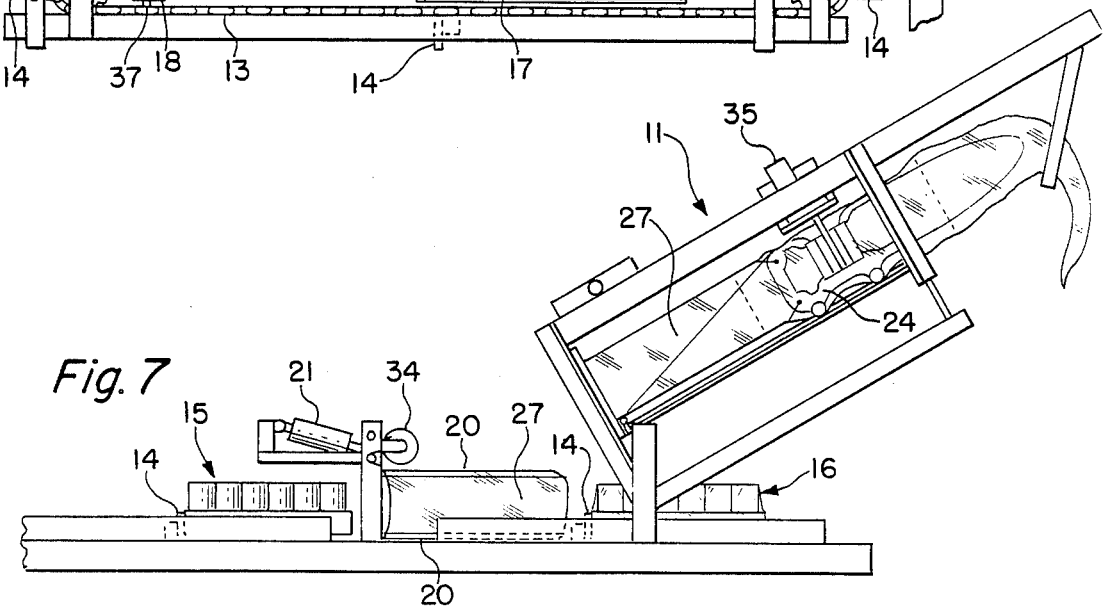
FIG. 7, is a view similar to FIG. 6, but showing the tube stretching jaw frame in the tilted-down position with the film tube section stretched on the stretching jaws having been separated from the remainder of the film tube stock.
Figure 11:
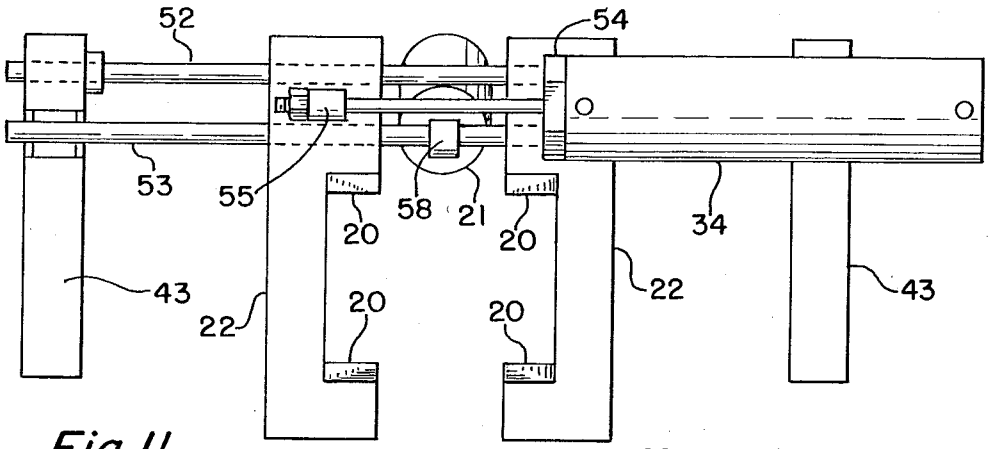
Figure 13:
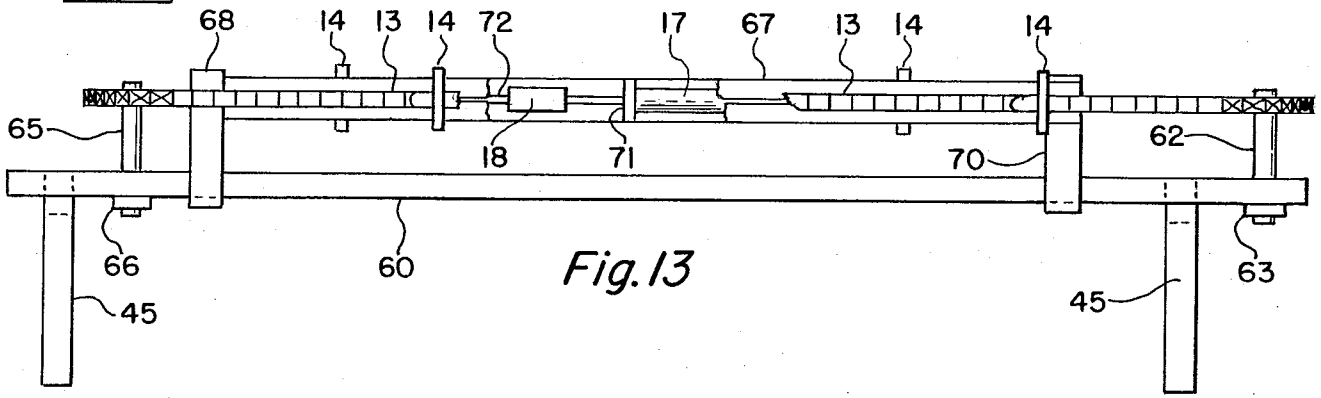
Figure 12:
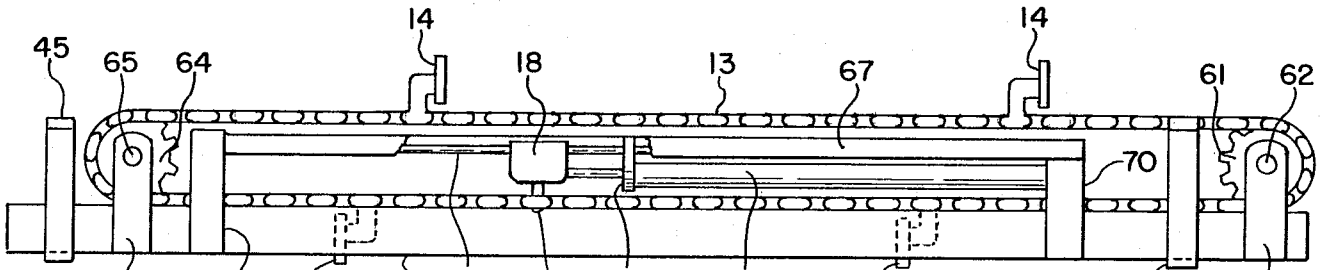
Figure 17:
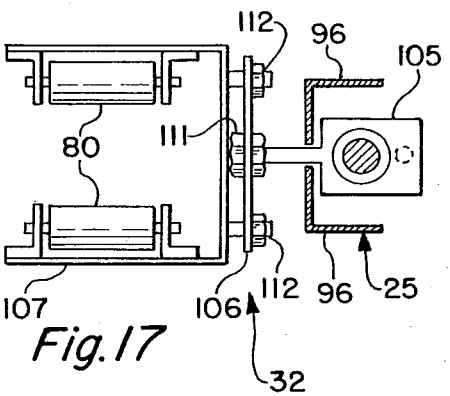
Figure 16:
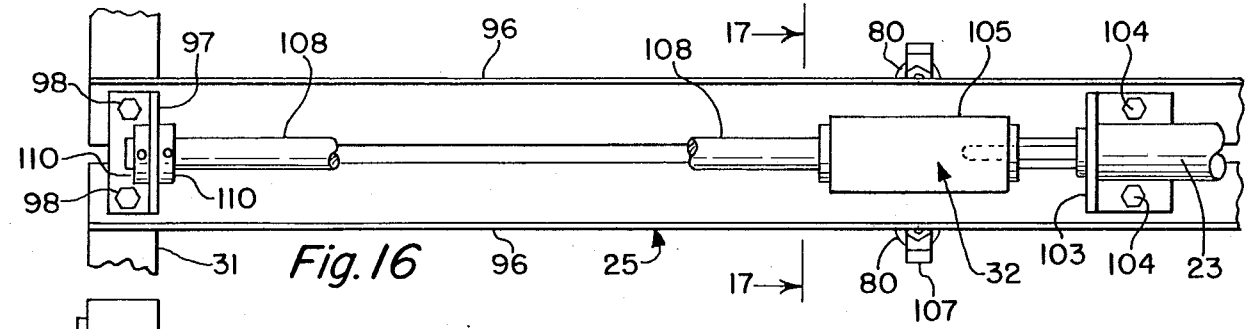
Figure 15:
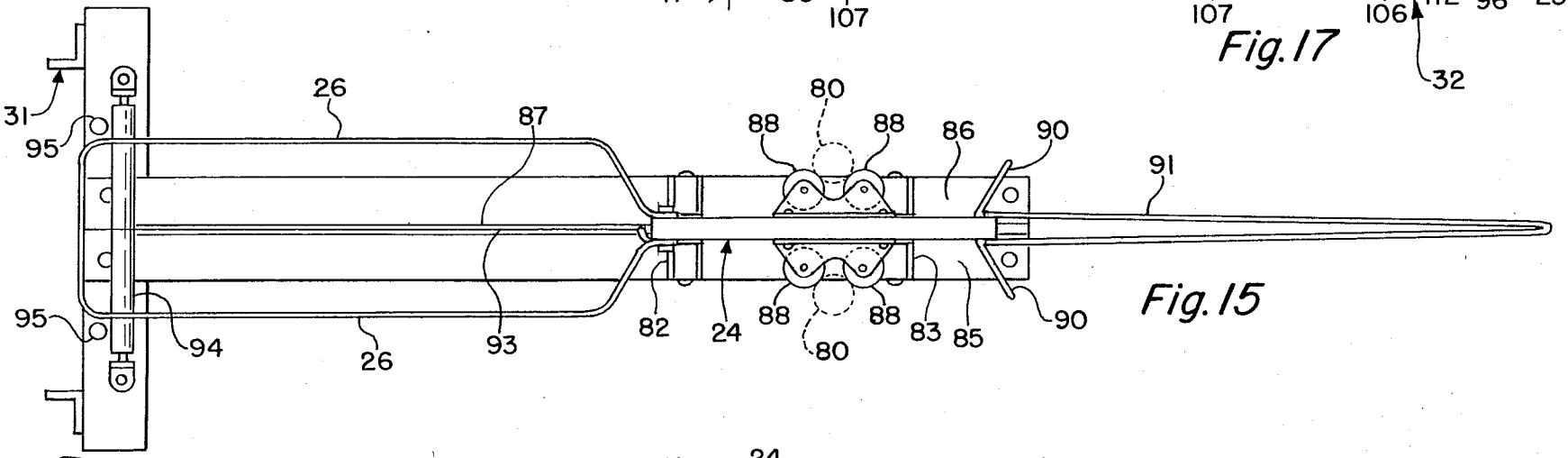
Figure 14:
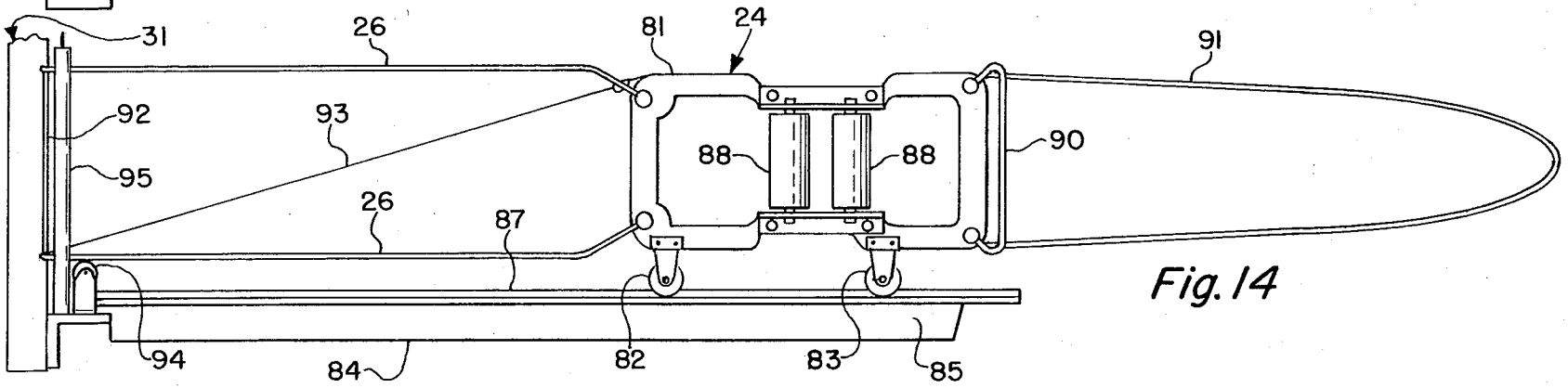

FIG. 8, is a view similar to FIG. 7, but with the entire shuttle mechanism omitted for simplicity, and showing the next step in the method and machine operation with the object to be packaged (which is the tray of cans shown in all of the previous figures as immediately upstream of the supporting frame for the stretching jaw frame) having been conveyed between the stretching jaws and within the stretched tube, and with the previously made package conveyed from the machine and with the next-to-be packaged object having been deposited on the conveyor at the input end of the machine;

FIG. 9, is a top plan view of FIG. 8, but with the tube stretching jaws having been moved to the closed or tube-applying position to make the package;

FIG. 10, is an enlarged side elevational view of the stretching jaws, the jaw frame, the supporting frame for the jaw frame, and two of the four air cylinders of the machine;

FIG. 11, is a front elevational of the structure shown in FIG. 10;

FIG. 12, is an enlarged side elevational view of the conveyor mechanism removed from the machine;

FIG. 13, is a top plan view of the structure shown in FIG. 12;

FIG. 14, is an enlarged side elevational view of the tube shuttle with fragmentary associated portions of the machine;

FIG. 15, is a top plan view of the structure shown in FIG. 14;

FIG. 16, is an enlarged fragmentary top plan view of the structure which is disposed above the shuttle of FIG. 15 in the machine; and FIG. 17, is a cross sectional view of the structure of FIG. 16 and taken along the line 17—17 of FIG. 16.

DETAILED DESCRIPTION OF THE INVENTION

The method and machine of the subject invention are based upon and use the teachings of U.S. Pat. No. 4,454,705 in the stretching of a thin-film elastic plastics tube and its application to a generally rectilinear object. Reference is made to that patent for a full description of such plastic tubes, the problems involved in their application in a highly stretched condition, and a method for their application to generally rectilinear objects. In the subject invention, generally rectilinear objects should be understood to be such objects as six-sided boxes rectilinear in every cross section and to be packaged singly or in multiples, or rectangular or square trays carrying a multiple of items such as cans, bottles or other items the tops of which are aligned in a substantially flat plane.

In a reduction to practice of a preferred embodiment, the objects were corrugated paper trays of 24–12 ounce beverage cans and the applied film tubes were taken from a 12 inch layflat linear-low-density polyethylene tubing stock approximately 1 and ½ mils in thickness.

Figure 2:
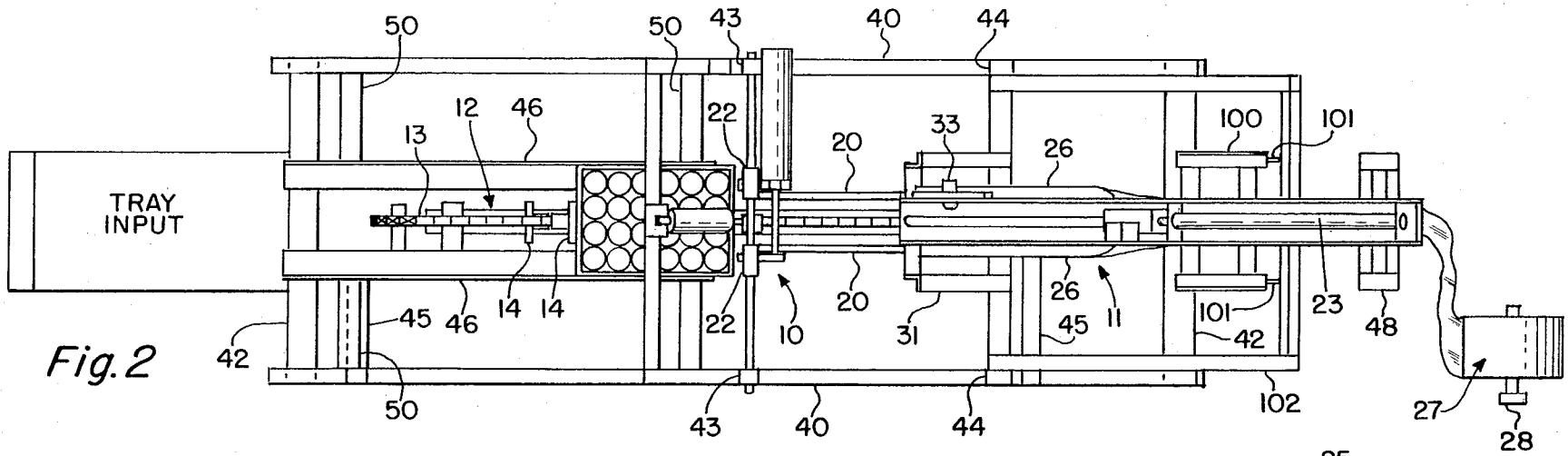
FIG. 2, is a top plan view of the machine of FIG. 1 with some of the conveyor omitted for clarity.
Figure 1:
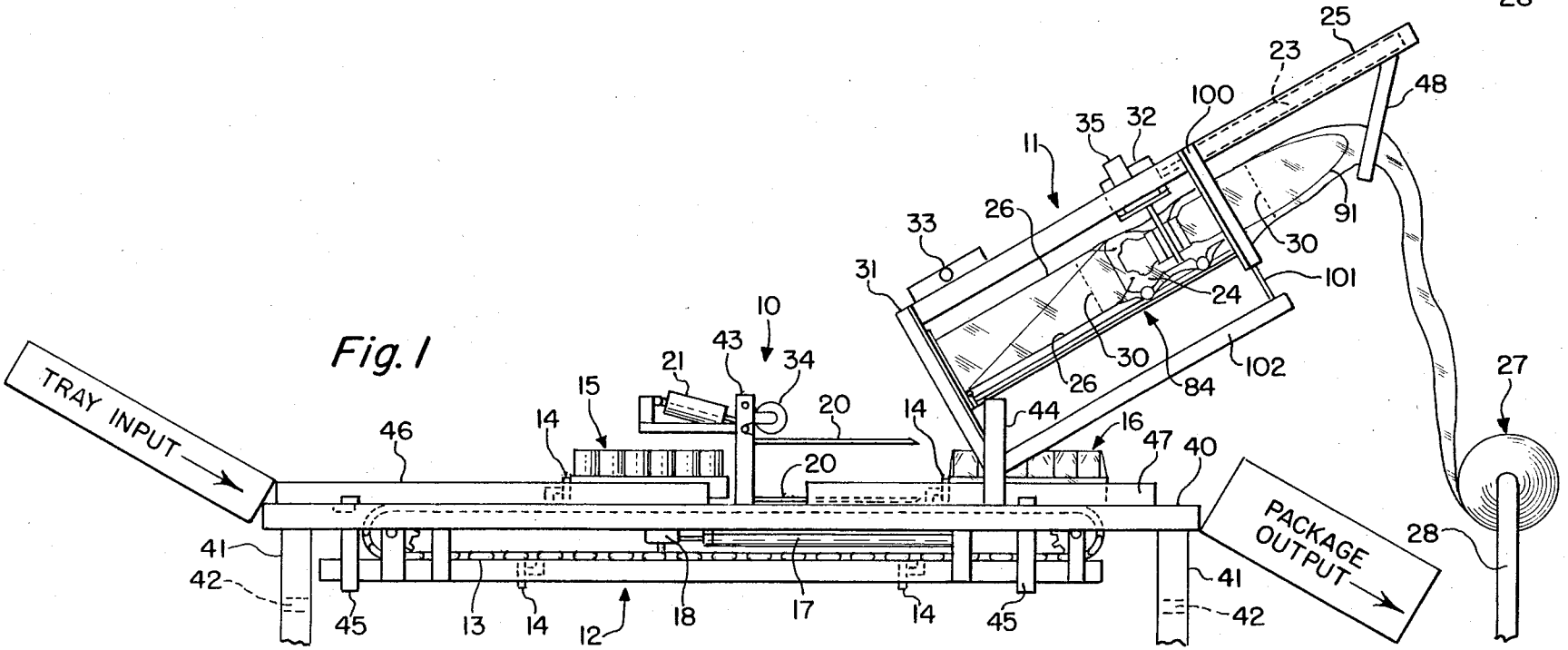
FIG. 1, is a side elevational view of a preferred embodiment of the machine of the invention.

Referring to FIGS. 1 and 2, the box identified with the legend "TRAY INPUT" can be a commercially available tray former serially delivering trays of cans to the input end of the machine conveyor. The box identified with the legend "PACKAGE OUTPUT" can be a commercially available pallet loader taking packaged trays as they are discharged from the machine by the machine conveyor at the output end of the conveyor.

The basic machine essentially comprises three mechanisms, a tube stretching and application mechanism 10, a tube delivery mechanism 11, and an object conveying mechanism 12.

The manner in which those three mechanisms operate and cooperate to package an object is shown in a series of steps starting and ending with FIG. 1, with FIGS. 3 through 9 displaying the intermediate steps. In a preferred embodiment, the conveyor chain 13 of the conveyor mechanism 12 is provided with four paddles 14 for moving the objects to be packaged. As shown in FIG. 1, the machine carries an object 15 to be packaged and a packaged object 16. As viewed in FIG. 1, the chain 13 is intermittently moved in a clockwise direction by an air cylinder 17 and a ratchet assembly 18 described in more detail hereinafter.

When the chain 13 moves an object 15 to the position shown in FIG. 1 immediately upstream of the mechanism 10, that object position is the start of a machine cycle. Simultaneously, when the chain 13 moves an object 16 out of the closed four tube stretching jaws 20 of the mechanism 10 and immediately downstream thereof, that object or package position is the end of a machine cycle. At that latter position the package can be removed from the machine, but in the preferred embodiment it is conveniently discharged from the machine upon the next movement of chain 13.

The arrival of the object 15 at the cycle start position causes the object 15 to operate a remote air pilot operator (not shown) below the object 15, and pilot operator shifts a two-position four-way jaw-tilt air valve to extend the air cylinder 21. To concisely describe the invention, it is believed that the basic air valves for operating the four air cylinders, the remote air pilots for operating the air valves, and all of the various air lines connecting the air equipment need not be shown and described in detail. With the references and description made herein, it is believed that a person skilled in this art can practice the invention with the purchase and assembly of standard air equipment parts selected from the catalogs or with the advice of air equipment manufacturers. For example, two such presently known manufacturers are the Humphrey Products Company of Kalamazoo, Michigan, and the Bimba Manufacturing Company of Monee, Illinois. Also, those skilled in this art will appreciate that for convenience or further simplicity and where appropriate, a two-way valve can be substituted for a four-way valve and an air cylinder with a spring return can be substituted for the two-way air cylinders described herein for a preferred embodiment.

Figures 3, 4, 5, 6:
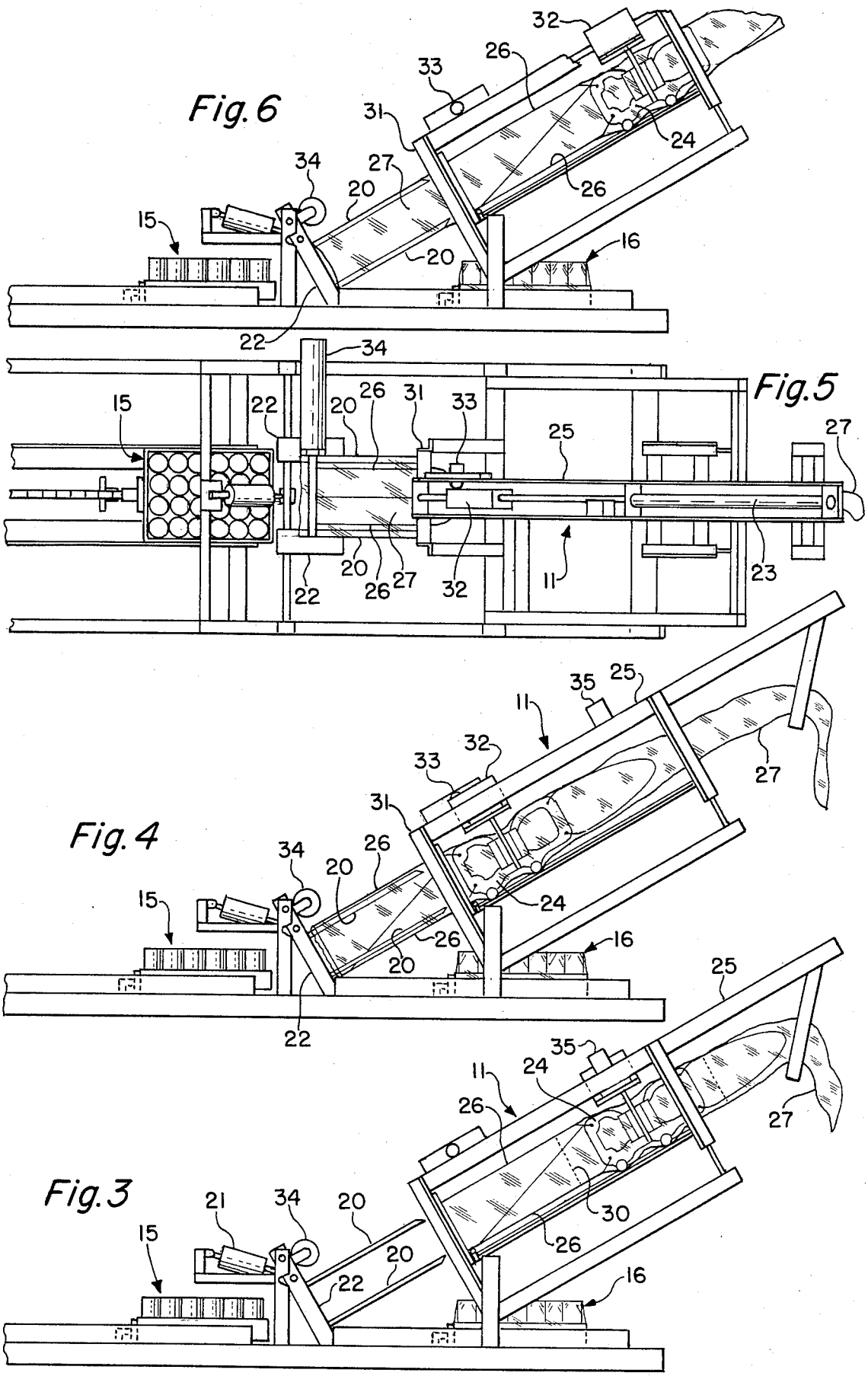
FIG. 3, is a partial view of the machine of FIG. 1 showing the tube stretching jaw assembly in a tilted-up position.
FIG. 4, is a view similar to FIG. 3, but with the tube shuttle in the advanced or down position applying a film tube section over the tube stretching jaws.
FIG. 5, is a top plan view of the machine of FIG. 4, but with some of the conveyor omitted for clarity, and showing the tube stretching jaws in the open or stretched tube position.
FIG. 6, is a view similar to the noted side elevational views, but showing the next step in the method and machine operation of the invention which is the holding of the tube stock by the stretching jaws in the open position as the tube shuttle has retracted or returned through the tube stock.

With the extension of the air cylinder 21, the four jaws 20 in the closed position are tilted upwardly from the generally horizontal position of FIG. 1 to that shown in FIG. 3. In the closed position, the four jaws 20 extend in a parallel spaced-apart relationship to define a relatively small rectilinear pattern. In that pattern the vertically arranged pairs of jaws 20 are substantially closer together than the transverse width of the object 15, and the upper jaws are fixed relative to the lower jaws a spaced-apart distance slightly greater than the height of the object 15. When the jaws 20 reach the titled-up position, a remote pilot operator (not shown) is operated by a finger (not shown) carried on the jaw frame 22. That pilot operator will shift a two-position four-way shuttle valve (not shown) to extend the air cylinder 23 to move the tube shuttle 24 of the tube delivery mechanism 11 from the position shown in FIG. 3 to that shown in FIG. 4. The air cylinder 23 is not shown in FIGS. 3 or 4 because it is within a channel assembly 25. The air cylinder 23 is identified in FIGS. 1, 2 and 5, and its detailed construction and arrangement with the shuttle 24 will be described hereinafter.

The forward or leading end of the shuttle 24 comprises four elongated members 26 carried in a rectilinear pattern slightly larger than the rectilinear pattern of the four jaws 20 in the closed position. A roll of elastic plastics film tubing stock 27 is carried on a floor stand 28 and the leading end of the stock 27 is directed over the shuttle 24 and the members 26 thereof. Thus, the members 26 hold the leading end of the stock 27 open in a relatively small rectilinear pattern slightly larger than the closed jaw pattern, and in the movement of the shuttle 24 to the down or tube-applied position of FIG. 4 a tube section is applied telescopically of the jaws 20. In the preferred embodiment, the tubing stock 27 is perforated at incremental positions therealong. The perforations are shown at 30 in the drawings. The perforations 30 are not seen in FIGS. 4, 5 and 6 because they are within or just at the edge of the rectangular frame 31 of the tube delivery mechanism 11.

The next operation is caused by the shuttle carrier 32 engaging the remote air pilot operator 33 mounted adjacent the channel assembly 25. The operator 33 is connected by air lines (not shown) to shift a two-position four-way jaw-stretch valve (not shown) to in turn cause air cylinder 34 to extend. Air cylinder 34 in extending moves the vertically aligned pairs of jaws 20 transversely apart to stretch the tube 27 thereabout. That position of the jaws 20 is shown in the top plan view of FIG. 5, and in that position the jaws 20 define a rectilinear pattern slightly larger than the rectilinear pattern defined by the top, bottom, and two longitudinal sides of the object 15.

In the stretched position of the film tube 27 on the jaws 20, the tube is virtually locked thereon or at least held so tightly that sliding removal longitudinally of the jaws 20 is difficult without tearing of the tube. The next operation is caused by the jaw frame 26 engaging a remote air pilot operator (not shown) as the jaws 20 reach the open tube-stretched position. That pilot operator causes the shuttle valve (not shown) to shift to its other position to cause air cylinder 23 to retract. As air cylinder 23 retracts it carries the shuttle carrier 32 which in turn carries the shuttle 24 to retract the members 26 thereof from telescopic engagement of the jaws 20 to the shuttle return position shown in FIG. 6. As will be described hereinafter in detail, rollers on opposite sides of the shuttle 24 mesh with opposed rollers carried by the shuttle carrier 32 with the tube 27 over the shuttle rollers and between the shuttle carrier rollers so that as the tube 27 is held by the jaws 20 and the shuttle 24 is retracted the rollers of the shuttle and shuttle carrier roll over the stationary tube 27. FIG. 6 shows that with the shuttle 24 retracted it is within the next section of tube to be applied to an object to be later delivered to the conveyor mechanism 12.

When the shuttle 24 is retracted, the shuttle carrier 32 engages a remote air pilot operator shown at 35 in FIG. 7. The operator 35 is connected by air lines (not shown) to the jaw-tilt valve (not shown) to shift that valve to its other position. The shifting of that valve causes the air cylinder 21 to retract tilting the jaws 20 to the down or generally horizontal position. As the jaws 20 tilt down, they snap or otherwise separate the stretched tube along perforations 30 from the tubing stock on the shuttle 24. That condition of the machine is shown in FIG. 7. The invention contemplates that in the alternative, the perforations 30 can be omitted and the stretched tube on the jaws 20 can be cut as with a hot wire from the tubing stock on the shuttle 24 before the jaws 20 are lowered.

The next operation is caused by the jaw frame 22 and jaws 20 reaching the down position. Conveniently a remote air pilot operator (not shown) may be engaged by the jaw frame 22 in lowering and that operator will cause a two-position four-way conveyor air valve (not shown) to shift to a position delivering air under pressure to conveyor air cylinder 17 to extend air cylinder 17. As air cylinder 17 extends it moves ratchet assembly 18 to move the conveyor chain 13. As the conveyor chain 13 moves, the paddle 14 immediately upstream of the object 15 as shown in FIG. 7 will move the object 15 from the position shown in FIG. 7 through the jaw frame 22 to the position shown in FIG. 8. As shown in FIG. 8, the object 15 is then between the jaws 20 and within the stretched tube 27. In FIG. 8 the tube applying mechanism 11 is omitted from the drawing for simplicity. It should be noted in FIG. 8 that the next downstream paddle 14 has discharged the packaged object 16 shown in FIG. 7 from the machine, and in FIG. 8 that paddle 14 is facing downward at the output end of the machine. It should also be noted that a new object 36 has been delivered to the input end of the machine. The object 36 will be moved by paddle 14 shown in FIG. 8 extending horizontally at the input end of the machine.

In the preferred embodiment, a remote air pilot operator (not shown) mounted near the input end of the machine is engaged by the ratchet assembly 18 when it reaches the position shown in FIG. 8. The operator will then shift the conveyor valve to its other position and that valve will cause the conveyor air cylinder to retract. In retracting the pawl 37 of the ratchet assembly will slide over the rollers of the chain without moving the chain 13. It should be noted that the air cylinder 17 is the only cylinder in the machine which in operating causes its own retraction. Thus in the automatic cycling of the machine, the air cylinder 17 can be retracting simultaneously with another machine operation.

The next operation is caused by the conveyor mechanism 12 having moved the object 15 within the stretched tube 27. Conveniently in the preferred embodiment, a remote air pilot operator (not shown) is mounted adjacent the center of the lower flight of the chain 13. At that position the operator is engaged by the paddle 14 shown in FIG. 8 on the lower flight of the chain 13 near the center of the machine. The operation of that operator causes the jaw-stretch valve (not shown) to shift to its other position to cause air cylinder 34 to retract to move the jaw frame 22 to move the jaws 20 to the closed position. That condition of the machine is shown in the top plan view in FIG. 9.

When the jaw frame 22 closes, it engages a remote air pilot operator (not shown) connected to the conveyor valve (not shown) to again shift that valve to extend the conveyor air cylinder 17. Again, the conveyor chain will be moved by the pawl 37 of the ratchet assembly 18 to move the paddles 14. The paddle 14 shown on the upper flight of the chain 13 in FIG. 8 will move the object 15 with the applied tube 27 from the closed jaws 20 shown in FIG. 9. In that operation the object 15 will be moved to and become the package 16 of FIG. 1. Meanwhile, the horizontal paddle 14 at the input end of the machine will move object 36 to the position of and it will become object 15 of FIG. 1. As previously described, the conveyor air cylinder 17 will again initiate its own retraction to regain the position of FIG. 1. The machine is then in the condition described relative to FIG. 1 and a new cycle of operation will automatically ensue. Short of disconnecting air under pressure from the described remote air pilot operators and the four valves, the machine will stop if no object 36 is delivered to the machine as described. That is because as described above relative to FIG. 1, the arrival of the object to the position immediately upstream of the mechanism 10, the cycle start position, causes a cycle to begin.

Referring to FIGS. 1 through 9 for a further description of the construction of the preferred embodiment, the main machine frame elements are two horizontally spaced-apart parallel box channel members 40. The members 40 are secured in their spaced-apart relationship by depending legs 41 and cross members 42 which may be seen in FIGS. 1 and 2. Each of the three basic mechanisms, the tube stretching and application mechanism 10, the tube delivery mechanism 11, and the object conveying mechanism 12, is secured to and carried by the members 40. The tube stretching and application mechanism 10 is mounted on the frame members 40 by a pair of upright jaw frame support members 43 secured in a transversely spaced-apart relationship of and on the members 40. The tube delivery mechanism 11 is mounted on the frame members 40 by a pair of transversely spaced-apart upright frame members 44. The object conveying mechanism 12 is mounted on one of the frame members 40 by a pair of longitudinally spaced-apart hanger members 45.

Additionally as shown in FIGS. 1 and 2, the machine is provided with upstream object supports and guides 46, downstream object supports and guides 47, and a tube stock guide 48. The guides 46 are carried by members 50 shown in FIG. 2 in a parallel spaced-apart relationship longitudinally of the machine and at a height to guide an object between the jaw frames 22 and the four jaws 20 when the jaws 20 are open. The guides 47 are carried by members 51 shown in FIG. 9 in a parallel spaced-apart relationship longitudinally of the machine and at a height to receive and guide an object from the jaws 20 to the output end of the machine. A showing of the guides 47 is omitted from FIG. 2 to avoid confusing the view. The guide 48 has two transversely spaced-apart members depending from the channel assembly 25 of the tube delivery mechanism 11 and a horizontal roller carried between the lower ends thereof to guide the tube stock 27 from the stand 28 and onto the rearward end of the tube shuttle 24. The guides 46, 47, and 48 may be made in the simple functional forms shown or more complicated for special guiding needs if necessary. For example, the guides 46 and 47 may include friction reducing rollers or wear strips, and the guide 48 may be replicated and further mounted on the stand 28 if a more tortuous tube path to the machine is required.

FIGS. 10 and 11 show the tube stretching and application mechanism 10 enlarged and with the jaw frame supporting members 43 removed from the machine. As can be seen in FIG. 11, the jaw frame members 22 are somewhat U-shaped to carry a vertically aligned pair of jaws 20 on the inner sides of the legs thereof and to be cantilevered from the members 22 in a parallel spaced-apart relationship. The fixed vertical distance between the opposed surfaces of each vertical pair of jaws 20 is slightly greater than the height of the object to be packaged. In FIG. 10 it may be seen that the upper and outwardly directed corners of the upper jaws 20 and the lower and outwardly directed corners of the lower jaws 20 are provided adjacent their anchored ends with linear series of notches 39. It appears that as an elastic plastics tube is highly stretched by and about the jaws 20, the stretched plastic material enters the notches in curvilinear folds or undulating patterns and that arrangement serves to hold the tube against sliding toward the free ends of the jaws 20. The upper end of each member 22 is provided with two sets of bearings with the sets mounted in a parallel spaced-apart relationship and an upper shaft 52 and a lower shaft 53 are journaled through those bearings so that the members 22 are mounted in the side-by-side relationship seen in FIG. 11 with the four jaws 20 defining a rectilinear pattern. The bearings and the shafts 52 and 53 are formed to permit the members 22 with the jaws 20 in vertical pairs to slide toward and away from each other and to permit the shafts 52 and 53 to rotate relative to the members 22. The air cylunder 34 which moves the frame members 22 toward and away from each other on the shafts 52 and 53 is mounted by a collar 54 at the rod end thereof on one of the jaw frame members 22. The collar 54 is provided with a radial stud which extends through the member 22 between the shafts 52 and 53. The piston rod of the air cylinder 34 is carried in a collar 55, and the collar 55 is provided with a radial stud which extends through the other member 22 between the shafts 52 and 53. Thus it can be seen that when air cylinder 34 is extended by air under pressure delivered to the head end of the cylinder with the rod end connected to exhaust, the vertical pairs of jaws 20 will be moved apart. When air under pressure is delivered to the rod end of the cylinder 34 with the head end connected to exhaust, the vertical pairs of jaws 20 will be moved together as the members 22 slide toward each other on the shafts 52 and 53. Stops (not shown) may be provided on one or both of the shafts 52 and 53 to determine the open and closed positions of the jaws 20.

The ends of the shafts 52 and 53 extend through the upper ends of the frame supports 43 so that the support members 43 support the jaw frames 22 therebetween through the upper shaft 52. On the sides of the frame supports 43 opposite of that from which the jaws 20 extend, a U-shaped frame 56 is provided. The ends of the legs of the frame 56 are secured to the frame supports 43 at about the height of the lower shaft 53. The walls of the support members 43 about the shaft 53 in the direction that the jaws 20 extend are removed in a somewhat V-shape as can be seen in FIG. 10. That arrangement permits jaw frames 22 to be pivoted about the axis of shaft 52 to tilt the jaws 20 upwardly and downwardly as previously described. The head end of the jaw-tilt air cylinder 21 is mounted in a trunnion assembly 57 as may be seen in FIG. 10. The trunnion assembly is mounted on the cross piece of the frame 56. The piston rod of the air cylinder 21 is secured to a collar 58 journaled on the lower shaft 53 between the jaw frames 22 as can be seen in FIG. 11. Thus it can be seen that if air under pressure is delivered to the head end of cylinder 21 with the rod end connected to exhaust, the air cylinder will be extended to move the shaft 53 out of the support members 43 to in turn pivot the members 22 on shaft 52 to in turn tilt the jaws 20 upwardly as previously described. If air under pressure is then delivered to the rod end of cylinder 21 with the head end connected to exhaust, the jaws 20 will be lowered until the ends of the shaft 53 engage the inner walls of the support members 43. The invention contemplates that adjustable stops (not shown) can be provided on the frame 56 for selecting and setting the up and down positions of the jaws 20.

FIGS. 12 and 13 show the object conveyor mechanism 12 removed from the machine by unsecuring the hanger members 45 from the main frame member 40 of the machine. The lower ends of hanger members 45 are secured in a longitudinally spaced-apart relationship to an elongated frame member 60. Adjacent the end of the member 60 at the downstream end of the machine a chain sprocket wheel 61 is provided. The wheel 61 rotatively mounted on a shaft 62 is carried on the member 60 through a bracket 63 which carries the shaft 62. The bracket 63 is secured to one side of the member 60 to upstand therefrom as can be seen in FIG. 12. A second chain sprocket wheel 64 is rotatively carried at the other end of the member 60 through a shaft 65 and upstanding bracket 66. A continuous roller chain 13 is carried tightly about the two wheels 61 and 64. Although not shown, a chain tensioner can be provided by pivotally mounting the lower end of the bracket 66 to the member 60, and by connecting a substantial spring between the upper end of the bracket 66 and the member 60 to pull the wheel toward the input or upstream end of the machine.

As described previously, the chain 13 is provided with four paddles 14. The paddles 14 are equally spaced-apart along the chain 13 and the distance between paddles is twice the stroke or extension distance of the conveyor air cylinder 17. To mount the air cylinder 17, a U-shaped frame 67 is provided. In one reduction to practice, the frame 67 was made with two sections of steel angles. With the two angles positioned slightly apart and in an inverted U-shape they are secured to brackets 68 and 70. Bracket 68 which is L-shaped is secured at one end to the side of member 60 a short distance downstream from bracket 66. The other end or leg of bracket 68 extends between the upper and lower flights of the chain 13 with the frame 67 secured to the underside thereof. Bracket 70 is also L-shaped with one end secured to the member 60 upstream from wheel 61. The other leg of bracket 70 extends between the upper and lower flights of the chain 13 with the frame 67 secured to the upper side thereof. Within the frame 67 at about the longitudinal center thereof, a plate 71 is secured in a depending condition as can be seen in FIGS. 12 and 13 where portions of the walls of frame 67 have been removed. A similar plate (not shown) is provided in the frame 67 beneath the bracket 68. A shaft 72 is mounted and secured through those plates. The ratchet assembly 18 is journaled on the shaft 72 to be freely movable in both dircetions therealong. In a preferred embodiment the upper side of the ratchet assembly 18 is flat and closely adjacent to the underside of the horizontal cross wall of the frame 67. That arrangement serves to hold or guide the ratchet assembly 18 in a vertical plane with the lower portion therof carrying the pawl 37 directly above the lower flight of chain 13. Further, when the frame 67 is made of spaced-apart angles, low friction edging strips (not shown) of a material such as carbon filled polyethylene can be applied to the facing edges of the angles immediately above the upper surface of the ratchet assembly 18 to reduce noise and wear on the upper portion of the ratchet assembly 18.

The pawl 37 of the ratchet assembly 18 projects downwardly from the assembly and between adjacent rollers of the lower flight of the chain 13. The ratchet assembly 13 is internally constructed so that the pawl 37 is stationary in the assembly when the assembly is slid along the shaft 72 in a direction upstream or toward the wheel 64, and so that the pawl 37 freely pivots over the rollers of chain 13 when the assembly is slid along the shaft 72 in a direction downstream or toward wheel 61. The rod end of the air cylinder 17 is secured to the plate 71 with the piston rod of the cylinder extending through plate 71 and with the remainder of the cylinder within frame 67 and extending toward bracket 70. The end of the piston rod of cylinder 17 is connected to ratchet assembly 18 below shaft 72. Thus it may be seen that when air under pressure is delivered to the head end of cylinder 17 with the rod end of the cylinder connected to exhaust, the cylinder 17 will extend to move the ratchet assembly 18 upstream along the shaft 72, and the pawl 37 in the stationary condition relative to the assembly will move the lower flight of chain 13 in the upstream direction. The paddles 14 on the upper flight of chain 13 will then be moved downstream. If air under pressure is then delivered to the rod end of cylinder 17 with the head end connected to exhaust, the cylinder will retract pulling the ratchet assembly 18 back along the shaft 72. During this retraction operation the chain 13 will not be moved as the pawl 37 will merely pivot over the chain rollers.

FIGS. 14 and 15 respectively show the shuttle assembly 24 in side elevational and top plan views and with fragmentary portions of the tube delivery mechanism 11. FIG. 16 shows a fragmentary portion of the mechanism 11 in the machine that is above the structure shown in FIG. 15. That location is indicated by the dotted line rollers 80 in FIG. 15.

In construction, the film tube shuttle assembly 24 should be made as light in weight as practically possible in order that that it may be reciprocatingly moved with a minimum of momentum near the end of each movement and to minimize any forces of the assembly 24 on the tube stock 27 during movement of the assembly 24. Therefore, in a preferred embodiment, the frame 81 of the shuttle assembly 24 is made of aluminum in a rectangular open skeletal shape. The lower side of the frame 81 is provided with two rollers 82 and 83. Rollers 82 and 83 each have a length which is substantially the width of the track assembly 84. The track assembly 84 can be made with two steel angles 85 and 86 and a rib 87. The angles 85 and 86 are secured together with the rib 87 disposed therebetween and with the rib 87 extending slightly above the side-by-side generally horizontal surfaces of the assembly 84 upon which the rollers 82 and 83 rest. The upwardly extending portions of the rib 87 should be rounded and smooth and the adjoining horizontal surfaces of the angles 85 and 86 should be smooth to minimize any abrasion of the tube stock 27. The rollers 82 and 83 have annular grooves at their longitudinal centers so that in resting upon angles 85 and 86, the rib 86 is within the annular grooves. The location of the track assembly 84 in mechanism 11 is indicated in FIG. 1.

The rollers 82 and 83, and the other rollers of the shuttle assembly 24, are preferably hollow aluminum rollers for light weight, and are rubber or elastomer covered to avoid abrading the tube stock 27. Brackets either integrally formed with the frame 81 or attached thereto rotatively mount the rollers 82 and 83 in a spaced-apart relationship along the lower side of the frame 81.

The shuttle assembly 24 further comprises four rollers 88. Brackets either integrally formed with the frame 81 or attached thereto rotatively mount the rollers 88 in parallel horizontally spaced-apart, vertically-aligned, pairs on opposite sides of the frame 81 as can be seen in FIGS. 14 and 15. Thus it can be seen that the axes of rotation of the rollers 88 are perpendicular to the axes of rotation of the rollers 82 and 83.

The shuttle assembly 24 further comprises two wire tube guides 90 and a wire tube guide 91. The wire tube guides 90 are generally C-shaped and are secured to the end of the frame 81 opposite of that carrying the members 26 and are secured generally upright in opposed positions on opposite sides of the frame 81 as can be seen in FIGS. 14 and 15. The wire guide 91 is shaped as a relatively long curvilinear V-shaped member and the ends of guide 91 are secured with the guides 90 to the upper and lower corners of the end of the frame 81 as can be seen in FIGS. 14 and 15.

In a preferred embodiment, the tube holding members 26 are made as two formed-wire members arranged in parallel planes except at the connection to the frame 81, where they converge. As can be seen in FIGS. 14 and 15, each formed-wire member is somewhat U-shaped with a cross piece at the forward end that positions the legs or elongated members 26 spaced-apart a distance slightly greater than the outer edge width of opposed upper or lower jaws 20 in the closed position. The end portions of each formed-wire member are curved toward each other and out of the plane of the elongated members 26 thereof as can be seen in FIGS. 14 and 15. In that formed-wire arrangement, the formed wires are secured to the forward end of the frame 81 to project therefrom in the opposite direction of the guide 91. The spacing between the upper and lower formed-wire members is slightly greater than the distance between a vertical pair of jaws 20 plus their thicknesses. Thus shuttle assembly 24 is movable to place the formed-wire members and the four elongated members 26 thereof over the jaws 20 in the closed position as described previously relative to FIG. 4.

In a reduction to practice of the invention, the formed-wire members were made of a spring steel rod about one eighth inch in diameter. That construction was found to render the shuttle sufficiently rigid to firmly hold the plastic tube open in the described relatively small rectilinear pattern with substantially no stretching of the tube. However, when the tube stock was perforated and the jaws snapped down as described relative to FIG. 7, it was found that a thin rigid strut 92 secured between the upper and lower cross pieces of the formed-wire members substantially at the center thereof as may be seen in FIG. 14, rendered the upper formed-wire member sufficiently stationary to provide for a clean snap and separation of the stretched tube on the jaws 20 from the tube stock on the shuttle as described relative to FIGS. 6 and 7. A further element which, although not appearing necessary, may be provided to add rigidity to the arrangement of the formed-wire members is a flexible wire strut 93. The strut 93 is connected between the lower end of the strut 92 and the upper front corner of the shuttle frame 81. The reason for the statement that the member 93 may not be necessary is that the guiding and support roller 94 shown in FIGS. 14 and 15 and rotatively mounted on the rectangular frame 31 at the forward end of the tube delivery mechanism 11 supports the lower formed-wire member and through the strut 92 also supports the upper formed-wire member. In some arrangements, the roller 94 may be omitted with the use of the flexible wire strut 93, but the roller 94 has an advantage in addition rendering support to front end of the shuttle and that is that it a simple and accurate guide for directing the shuttle over the jaws 20 in the titled-up position.

Two additional guide rollers 95 may be provided on the forward rectangular frame 31 to ensure accurate guiding of the shuttle onto the jaws, particularly when the machine is operated at a relatively high speed, such as at a rate of 30 or more objects per minute when the objects are trays of 24—12 ounce beverage cans. The rollers 95, as can be seen in FIGS. 14 and 15, are generally vertically aligned on each side of the formed-wire assembly previously described. In reductions to practice, it appears that the primary guide for the shuttle is the rib 87 of the track assembly 84 in cooperation with the annular grooves of the rollers 82 and 83.

The fragmentary top plan view showing of the channel assembly in FIG. 16 shows how the shuttle carrier 32 is itself carried. The channel assembly 25 is conveniently made of two steel angles 96 secured in an upwardly open U-shape. A short angle member 97 and fasteners 98 secure the angles 96 in a spaced-apart relationship with a slot therebetween to the upper side of the forward rectangular frame 31 of the tube delivery mechanism 11.

About midway of the length of the channel assembly 25, the rearward rectangular frame 100 of the mechanism 11 is provided as may be seen in FIGS. 1 and 2. The channel assembly 25 is secured to the upper surface of the frame 100 and the underside of the frame 100 is provided with two adjustable legs 101. The legs 101 are carried on tha cross piece of a U-shaped frame 102, again, as may be seen in FIGS. 1 and 2. The legs of the frame 102 are disposed below and parallel to the channel assembly 25 and at their forward ends, are each secured to one of the upright supports 44 on the main frame members 40. The frame 102 is disposed at an angle to the horizontal which is substantially that of the jaws 20 in their tilted-up position. The rearward end of the previously described track 84 for the shuttle 24 is secured to the lower side of the rectangular frame 100 to align the track 84 substantially at the angle to the horizontal of the jaws 20 in their tilted-up position. As may be noted from the drawings, the rearward end of the shuttle assembly in the form of the guide 91 extends through the rearward rectangular frame 100.

Also about midway of the length of the channel assembly 25, another short angle 103 is provided as may be seen in FIG. 16. The angle 103 is secured to the angle members 96 by fasteners 104. The shuttle air cylinder 23 is positioned within the channel assembly 25 and the rod end of the cylinder extends through and is secured to the upstanding leg of the angle 103. The piston rod of the air cylinder 23 is secured in the upper rearward end wall of the shuttle carrier 32.

The shuttle carrier 32 is a compound assembly of about five parts. Referring to FIGS. 16 and 17, the carrier 32 comprises a carrier block 105, a cross member 106, a bail member 107, and two rollers 80. The carrier block 105 is somewhat T-shaped in transverse cross section. The upper portion of the block 105 is journaled on a shaft 108 through the medium of two bearings, one at each end of the block 105. The forward end of the shaft 108 is mounted through the upstanding leg of the angle 97 and fixed in position by the stop collars 110. The rearward end of the shaft 108 extends through the upstanding leg of the angle 103 and below the rod end of the shuttle air cylinder 23. The piston rod of the cylinder 23 is connected to the block 105. The lower portion of the block 105 extends downwardly through the slot between the angle members 96 and is substantially narrower than the upper portion on the shaft 108. The lower portion of the block 105 may be a solid member longitudinally thereof or may preferably be bifurcated as two longitudinally spaced-apart depending members. The cross member 106 is a plate of two perpendicularly intersecting arms. The ends of one arm of member 106 are secured to the lower end of the lower portion of the block 105 below the channel assembly 25 by fasteners 111 which may be seen in FIG. 17. The ends of the other arm of member 106 are secured adjacent to the ends of the cross member of the bail member 107 by fasteners 112. Thus it may be seen that by using shims of appropriate thicknesses between the cross member 106 and the lower portion of the block 105, and between the cross member 106 and the bail member 107, the legs of the bail member 107 can be adjusted to align those legs parallel to the axes of the rollers 88 of the shuttle assembly 24. The rollers 80 are rotatively mounted on the inner sides of the legs of the bail member 107 with the axes of rotation of the rollers parallel to the longitudinal showing of the rollers 80 in FIG. 15, a study of that figure in conjunction with FIGS. 14, 16 and 17 will show how the shuttle carrier 32 can move the shuttle assembly 24 along the track 84. As is apparent from a consideration of the other figures of the drawings, the tube stock 27 is directed between the rollers 80 and on top of the track 84 to completely encircle the shuttle assembly 24 including the elongated wire members 26, and the guide 91.

If air under pressure is delivered to the head end of air cylinder 23 with the rod end connected to exhaust, the cylinder will be extended to move the shuttle carrier 32 to in turn carry the shuttle assembly and the tube stock 27 thereabout downwardly along the track 84. If the jaws 20 are closed and in the tilted-up position, the members 26 will telescopically apply the tube 27 about the jaws 20. Because of the frictional holding force of the members 26 on the tube 27, the light weight of the shuttle assembly, the direction of the moving force on the shuttle assembly, and the minimum surface contact between the rollers 82 and 83 and the track 84, the portion of the tube between the rollers 82 and 83 and the track 84 will slide with the shuttle assembly.

If air under pressure is then delivered to the rod end of the air cylinder 23 with the head end being connected to exhaust, the cylinder will be retracted to move the shuttle carrier 32 to in turn move the shuttle assembly upwardly and rearwardly along the track 84. If the previously applied tube section has been stretched and is held by the jaws 20, the nexxt tube section encircling the shuttle will remain stationary on the track 84 as the rollers 82 and 83 within the tube roll over its inner surface. Also, the areas of the tube sandwiched between rollers 80 and 88 will remain unmoved as those rollers roll over the inner and outer surfaces of the tube.

Having described the invention, it is to be understood that changes can be made in the described embodiments by a person skilled in the art within the spirit and scope of the claims.

I claim:

1. In a method for making a package of a generally rectilinear box or tray-like object encircled by a substantially stretched elastic plastics tube wherein four elongated jaws are rectilinearly arranged in two spaced-apart fixed pairs with the pairs movable toward each other to relatively small rectilinear tube receiving and tube releasing positions and movable away from each other to a relatively large rectilinear tube stretching position for receiving said object between said pairs of jaws and within a stretched tube, comprising the steps of:

providing holding means in two parallel spaced-apart planes and internally holding said tube with said holding means in a rectilinear pattern larger than the rectilinear pattern of said pairs of jaws in said tube receiving position and moving said holding means to telescopically apply said tube in one direction longitudinally of and over said pairs of jaws with said two parallel spaced-apart planes parallel to the direction in which said pairs of jaws are moved toward and away from each other, continuing to hold said tube with said holding means and moving said pairs of jaws away from each other to engage said tube in two spaced-apart parallel planes perpendicular to said two parallel spaced-apart planes of said holding means and moving said pairs of jaws to said tube stretching position, and thereafter moving said holding means in the opposite direction longitudinally of and away from said pairs of jaws and out of said tube, whereby said pairs of jaws and said stretched tube are prepared to receive said object therebetween and within.

2. In a method for making a plurality of packages each of which is a box or tray-like object encircled by a substantially stretched elastic plastics tube, comprising the steps of:

providing two pairs of elongated jaws with the jaws of each pair fixed in a parallel spaced-apart relationship at one end of each thereof and moving said pairs of jaws with the plane of each pair parallel to the plane of the other in rectilinear patterns alternately toward each other to relatively small tube receiving and tube releasing positions and away from each other to a relatively large tube stretching position capable of receiving one of said objects therebetween, providing a holding means of four elongated members carried in a parallel spaced-apart rectilinear pattern larger than the rectilinear pattern of said pairs of jaws in said tube receiving position and placing said holding means in one end of an indefinite length of tubing of a multiple of said tube to hold said one end of said tubing open in said rectilinear pattern of said four elongated members, moving said holding means to telescopically apply said one end of said tubing and said holding means over said pairs of jaws in said tube receiving position, thereafter moving said pairs of jaws away from each other to engage said tubing in two spaced-apart parallel planes and continuing to move said pairs of jaws outwardly of said four elongated members of said holding means to said tube stretching position, thereafter moving said four elongated members of said holding means longitudinally through said tubing and away from said one end thereof until said holding means is removed from telescopic application of said pairs of jaws, thereafter moving said pairs of jaws while in said tube stretching position transversely of said tubing and separating said tubing between the ends of said pairs of jaws and said holding means, thereafter moving said object between said pairs of jaws and within said one end of said tubing stretched thereon, thereafter moving said pairs of jaws together along opposite surfaces of said object to said tube releasing position, thereafter moving said object with said one end of said tubing stretched thereon longitudinally of and off of said pairs of jaws, and thereafter repeating the foregoing steps from the step of moving said holding means to telescopically apply said one end of said tubing and said holding means over said pairs of jaws in said tube receiving position.

3. In a method as defined in claim 2, the further steps of:

providing perforations in said indefinite length of tubing of a multiple of said tube with said perforations formed transversely circumferentially encircling said tubing substantially between each multiple of said tube, and in the step of moving said pairs of jaws while in said tube stretching position transversely of said tubing and separating said tubing the further step of moving said pairs of jaws transversely of said tubing with a force sufficient to part said tubing along any of said perforations between the ends of said pairs of jaws and said holding means.

4. A method for making a package of a generally rectilinear box or tray-like object encircled by a substantially stretched elastic plastics tube, comprising the steps of:

holding said object for intermittent movement along a substantially horizontal linear path, providing elastic plastics tubing stock of an indefinite length, providing a holding means in one end of said tubing stock and holding an incremental length of said one end of said tubing stock open in a rectilinear pattern and out of said path, providing a plurality of elongated jaws and holding said jaws in a first rectilinear pattern small enough to enter within said rectilinear pattern of said incremental length of said one end of said tubing stock and holding said jaws in longitudinal axial alignment with said one end of said tubing stock, moving said holding means to carry said one end of said tubing stock telescopically over said jaws in said first rectilinear pattern a distance of substantially said incremental length, moving said jaws apart into a second rectilinear pattern large enough to receive said object therebetween with said incremental length of said one end of said tubing stock stretched circumferentially thereabout, moving said holding means through said tubing stock and out of said jaws, separating said incremental length of said one end of said tubing stock from the remainder thereof, moving said jaws while held in said second rectilinear pattern into said linear path with the longitudinal axis of said incremental length of said one end of said tubing stock aligned with the axis of intermittent movement of said object, moving said object along said path and axially within said jaws and said incremental length of said one end of said tubing stock, moving said jaws over said object to said first rectilinear pattern to place said incremental length of said one end of said tubing stock in stretched encirclement of said object, and thereafter moving said object with said incremental length of said one end of said tubing stock in stretched encirclement thereabout along said path off of said jaws.

5. In a method as defined in claim 4, the further steps of:

forming said tubing stock with a series of perforations extending circumferentially thereabout substantially at the end of said incremental length of said one end of said tubing stock which is adjacent to said remainder thereof, and the step of separating said incremental length of said one end of said tubing stock from the remainder thereof comprising moving said jaws in a direction generally perpendicular to the longitudinal axis of said jaws sufficiently to separate said incremental length of said one end of said tubing stock from the remainder thereof by parting said tubing stock along said series of perforations.

6. In a packaging machine for making a package of a generally rectilinear box or tray-like object encircled by a substantially stretched elastic plastics tube, four elongated jaws, frame means for mounting said jaws in two pairs with each pair of two jaws fixed in a parallel spaced-apart relationship, frame supporting means for movably carrying said frame means to align said two pairs of jaws alternately in a relatively small rectilinear pattern position capable of receiving said tube in a substantially unstretched condition thereabout and in a relatively large rectilinear pattern tube stretching position capable of receiving said object therebetween, a tube holding shuttle comprising four elongated members mounted in a parallel spaced-apart rectilinear pattern larger than the small rectilinear pattern of said pairs of jaws and small enough to receive said tube thereabout in a substantially unstretched condition, and means for reciprocatingly mounting said shuttle for movement alternately telescopically over said two pairs of jaws and immediately longitudinally axially removed from said pairs of jaws.

7. In a packaging machine as defined in claim 6, said frame means comprising a jaw carrier for each pair of two jaws, securing means for each pair of two jaws for securing one end of each of said two jaws to said jaw carrier with said two jaws aligned in a parallel spaced-apart relationship and with the other ends of said jaws being cantilevered from said jaw carrier.

8. In a packaging machine as defined in claim 7, a linear series of notches formed in each of said jaws longitudinally thereof, each of said series of notches being positioned adjacent said one end of each of said jaws and on the outer side thereof in the corners defined by said rectilinear patterns, and said notches formed in a shape and sufficiently deep to substantially hold a tube in said relatively large rectilinear pattern tube stretching position against slipping toward said other ends of said jaws.

9. In a packaging machine as defined in claim 7, said frame supporting means comprising a pair of spaced-apart posts mounted upright in said machine, and a first shaft, bearing means in each of said jaws carriers for slidably carrying said jaw carriers on said shaft with said jaws extending in one direction substantially perpendicular to the axis of said shaft, means carrying said shaft substantially horizontally between said posts, and first air-cylinder means connected between said jaw carriers for selectively moving said pairs of jaws to said relatively small and relatively large rectilinear patterns.

10. In a packaging machine as defined in claim 9, a conveyor for moving said object along a certain linear path in said machine, said pair of spaced-apart posts being positioned to straddle said conveyor and said linear path with the cantilevered ends of said jaws extending in the direction of movement of an object by said conveyor, and means for pivoting said jaw carriers on said shaft to an object receiving position with said jaws aligned to receive an object therebetween when said jaws are in said relatively large rectilinear pattern and said conveyor is operated to move an object therebetween.

11. In a packaging machine as defined in claim 10, said means for pivoting said jaw carriers on said first shaft comprising a second shaft and second air-cylinder means, second bearing means in each of said jaw carriers for slidably carrying said second shaft through said jaw carriers with said second shaft in a parallel spaced-apart relationship to said first shaft, said second air-cylinder means connected to said second shaft and operable to a first position to pivot said jaw carriers about the axis of said first shaft to said object receiving position.

12. In a packaging machine as defined in claim 11, shuttle support means for supporting said means for reciprocatingly mounting said shuttle in said machine over said conveyor and adjacent to said other ends of said jaws, and said second air-cylinder means operable to a second position to pivot said jaw carriers about the axis of said first shaft to longitudinally axially align said jaws with the axis of reciprocation of said shuttle.

13. In a packaging machine as defined in claim 12, and said means for reciprocatingly mounting said shuttle for movement alternately telescopically over said two pairs of jaws and immediately longitudinally axially removed from said pairs of jaws comprising a track carried by said shuttle support means, and a shuttle carrier, first roller means on said shuttle carrier for movably carrying said shuttle carrier on said track, connecting means for mounting one end of each of said four elongated members on said shuttle carrier with said four members extending from one end of said shuttle carrier in said parallel spaced-apart rectilinear pattern larger than the small rectilinear pattern of said pairs of jaws and small enough to receive said tube thereabout in a substantially unstretched condition.

14. In a packaging machine as defined in claim 13, third air-cylinder means connected to said shuttle carrier for moving said shuttle carrier on said track when said second air-cylinder means is operated to said second position to selectively move said four elongated members of said shuttle telescopically over said two pairs of jaws and immediately axially removed from said jaws.

15. In a packaging machine as defined in claim 13, said shuttle carrier and said first roller means on said shuttle carrier being of a size small enough to permit said tube to slide thereover in a substantially unstretched condition.

16. In a packaging machine as defined in claim 15, said said track being mounted in said shuttle support means to carry said first roller means of said shuttle carrier on the upper side thereof and said first roller means being mounted on the underside of said shuttle carrier, second roller means mounted on each side of said shuttle carrier with the axes of rotation of said second roller means disposed perpendicular to the axes of rotation of said first roller means, a bail member having rollers on each leg thereof, a bail carrier supporting said bail member over said shuttle carrier with the rollers of said bail member engaging said second roller means on each side of said shuttle carrier to move said shuttle carrier in both directions along said track when said bail carrier is moved parallel to said track in both directions, and said second roller means being of a size to permit said tube to move between said second roller means and said rollers of said bail member in a substantially unstretched condition.

17. In a packaging machine as defined in claim 16, and means for selectively moving said shuttle carrier parallel to said track in both directions comprising a third shaft mounted in said shuttle support means substantially parallel to and vertically above said track, bail carrier bearing means in said bail carrier for movably carrying said bail carrier on said third shaft.

18. In a packaging machine as defined in claim 17, and a third air-cylinder means mounted on said shuttle support means and connected to said bail carrier to selectively move said bail carrier in both directions on said third shaft.

19. In a packaging machine for serially applying stretched elastic plastic tubes circumferentially about a plurality of objects of a certain length, a pair of chain sprocket wheels, means rotatively mounting said wheels for rotation about substantially parallel horizontally spaced-apart horizontally-aligned axes in said machine, a continuous chain carried about said wheels, a plurality of paddles secured to said chain to extend outwardly thereof and equally spaced-apart along said chain with the distance between adjacent paddles being at least twice said certain length, means for moving said chain intermittently incrementally in one direction about said wheels to move said paddles intermittently incrementally in said one direction distances substantially equal to one half of the distance between adjacent paddles along said chain, support means for slidably supporting said objects above and straddling the upper flight of said chain to position said objects for being slidably moved in said one direction by said paddles, a jaw assembly in said machine and including power means for operating said jaw assembly to a first position to hold a stretched plastic tube open with the axis of said tube aligned in said one direction and positioned to receive one of said objects therewithin and to a second position to release said stretched tube about one of said objects therewithin, and means for further mounting said jaw assembly in said machine immediately downstream of the start position of an intermittent incremental movement of one of said paddles on said upper flight of said chain.

20. In a packaging machine as defined in claim 19, control means for controlling the operation of said power means and said means for moving said chain to operate said means for moving said chain to incrementally move said paddles in said one direction between said operation of said power means.

* * * * *